United States Patent [19]

Schmit

[11] 3,938,707

[45] Feb. 17, 1976

[54] FLUID CONTAINING AND DISPERSING STRUCTURE

[75] Inventor: Justin M. Schmit, Pompano Beach, Fla.

[73] Assignee: Arctic Pac, Inc., Fort Lauderdale, Fla.

[22] Filed: Mar. 6, 1974

[21] Appl. No.: 448,617

[52] U.S. Cl. ..... 222/83.5; 222/88; 222/91; 222/183

[51] Int. Cl.[2] ..... B67B 7/28

[58] Field of Search ..... 222/81, 83, 83.5, 88, 89, 222/90, 91, 183, 105, 107, 570, 569, 541

[56] References Cited

UNITED STATES PATENTS

| | | | |
|---|---|---|---|
| 2,058,910 | 10/1936 | Plunkett | 222/89 X |
| 2,612,765 | 12/1952 | Gorey | 222/183 X |
| 2,873,886 | 2/1959 | Miskel et al. | 222/91 |
| 2,947,653 | 8/1960 | Fohr | 222/541 X |
| 3,128,913 | 4/1964 | Specketer | 222/541 X |
| 3,157,314 | 11/1964 | Nadler | 222/88 |
| 3,226,002 | 12/1965 | Walker | 222/183 X |
| 3,239,104 | 3/1966 | Scholle | 222/89 X |
| 3,580,423 | 5/1971 | Gilman | 222/81 |
| 3,809,290 | 5/1974 | Schmit | 222/90 X |

FOREIGN PATENTS OR APPLICATIONS

| | | | |
|---|---|---|---|
| 993,462 | 5/1965 | United Kingdom | 222/81 |

*Primary Examiner*—Robert B. Reeves
*Assistant Examiner*—Charles A. Marmor
*Attorney, Agent, or Firm*—Schroeder Siegfried Ryan & Vidas

[57] ABSTRACT

A fluid-containing and dispensing structure consisting of a flexible sealed fluid-containing pouch mounted within a container formed of a relatively rigid material compared with the pouch which is deformable. The container has associated therewith a pouring spout which cooperates with a tubular element positioned in the upper wall portion of the flexible sealed fluid-containing pouch to provide a passage for fluid in the pouch and is associated with a top wall structure of the container to enclose the pouch. The top wall structure cooperates with a side wall and the pouring spout to secure the pouring spout on the pouch with a bayonet portion of the pouring spout perforating the top wall portion to facilitate dispensing of the contents of the pouch through the pouring spout. The top wall structure is opened and removable from the remaining portion of the container and the pouch is readily removed therefrom and replaced by a similar pouch.

6 Claims, 7 Drawing Figures

FLUID CONTAINING AND DISPERSING STRUCTURE

It is therefore the general object of this invention to provide an improved and inexpensive means for packaging and dispensing fluids such as liquids contained in a flexible walled sealed fluid-container pouch having a rigid tubular element positioned in a wall thereof.

Another object of this invention is to provide a novel and improved means of packaging and dispensing fluids wherein the container including the pouring structure may be used repeatedly with successive and similar constructed pouches of fluids.

A further object of this invention is to provide an improved packaging and dispensing structure which makes possible a convenient, inexpensive and practical method of packaging, distributing, selling and dispensing fluids.

A still further object of this invention is to provide more economical means for packaging fluids contained in a pouch from which dispensation of the fluids such as liquids can be accomplished in a quick, simple, inexpensive and practical manner.

These and other objects of the invention will become apparent from the reading of the attached description together with the drawings wherein.

My invention in the packaging and dispensing structure for the fluids utilizes a pouch 10 which is formed of a sheet or a pair of sheets of flexible material capable of being secured to one another through the application of heat upon their registering surfaces. It incorporates a rigid tubular member 12 which is positioned in one of the sealed walls of the pouch with the tubular member having the surrounding wall portion drawn or stretched across the same to fit tightly around one end of the tubular member. The remaining portions of the pouch are sealed as by heat sealing along the remaining side edges with the edge opposite the tubular member being left open for filling. The tubular member is positioned in an edge which as will be later noted, becomes the top flexible edge of the pouch in use and the lower end of the pouch is sealed by a seam through a heat sealing method well known in the art after the pouch has been filled with the liquid or fluid which it is to contain. The preferable material for making the pouch is disclosed in my co-pending application, Ser. No. 352,581, filed Apr. 19, 1973, on a Flexible Liquid-Container. The rigid tubular member 12 is secured in the top wall of the pouch in any one of the appropriate manners such as disclosed in the above identified copending application. The preferred method applies a ring 15 over the flexible upper wall portion surrounding the end of the tubular member to frictionally hold the tubular member 12 in the upper wall of the pouch.

Figure 1:
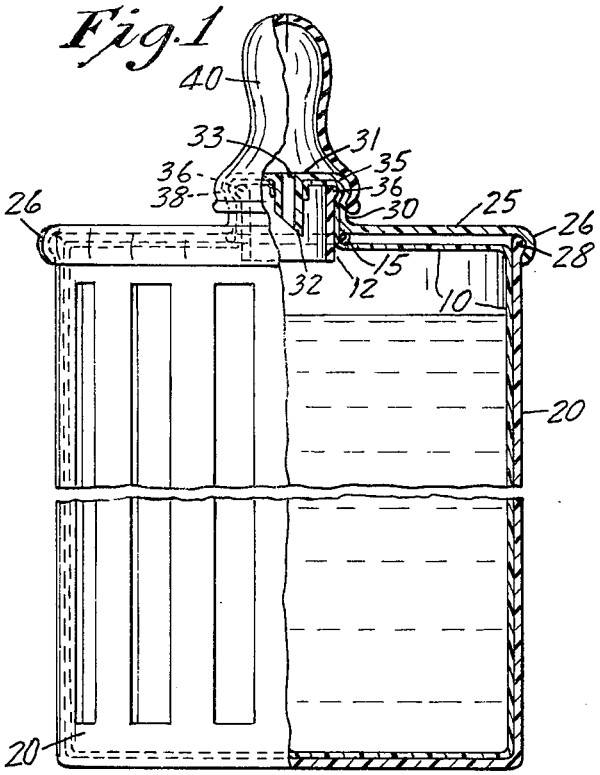
FIG. 1 is a side elevation view of the preferred embodiment of my invention with parts broken away.

In the drawings, several variations of the packaging structure are disclosed which correspond to the type of liquid or fluid contained in the pouch and the method of pouring or removing the fluid therefrom. Thus, in FIG. 1, the structure discloses an application for an infant's nursing bottle in which the container is a bottle shaped structure 20 being made of a relatively rigid material compared with the material of the pouch and having an internal dimension corresponding with the shape of the pouch in the filled condition. The rigid container includes slot or vent openings, such as was indicated at 22, around the side surface of the same. The container has a removable top wall structure 25 having a curved peripheral surface 26 adapted to fit over and snap on a flanged or ribbed extremity 28 on the top edge of the side wall of the container. The top wall structure 25 includes a pouring structure indicated generally at 30 which is in the form of a raised cylindrical hub formed integral with the top wall structure or closure 25 having a closed upper surface as indicated at 31, with a tubular piercing element or bayonet portion 32 formed integral therewith and extending back into the tubular receiving recess of the hub to define the tubular member receiving and piercing means of the pouring structure. The tubular or bayonet piercing element has a passage 33 therethrough. The pouring structure has a curved extremity 35 which as will be later noted which surrounds a ridge or upper extremity 36 of the tubular element 12 for the purpose of securing the same therein. This ridged or curved upper extremity of the pouring structure also serves as a lip for mounting the ribbed extremity 38 of a nipple 40 on to the pouring structure for the nursing bottle application. In the assembly of the pouch within the top wall portion of the container, the tubular element 12 is forced into the tubular element receiving recess or interior of the hub or upstanding pouring structure 30 so that the ribbed extremity 38 rests in the upper curved extremity 35 of the pouring structure. The depending piercing element 32 pierces the flexible wall of the pouch stretched across the end of the tubular element 12 and brings the passage 33 therein into fluid communication with the interior of the pouch. The top wall portion 25 of the container is snapped onto the outstanding sides of the container at the ribbed edge or extremity 28 to secure the same thereon and the tubular element 12 is held in frictional engagement with the pouring structure which is formed integral with the top wall portion or structure with this embodiment. The container thus forms a protective cover for the flexible walled pouch containing the liquid to be dispensed through the pouring spout and nipple 40 with the slots 22 in the walls of the container 20 providing for collapse of the bag therein in a recognized nursing bottle application. This insures that the pouch will collapse as it is emptied preventing an air space to exist within the interior of the pouch 10 as the fluid therein is drawn therefrom. The container is readily reusable and the top structure readily removable with the pouch being disposable after the fluids or liquid therein has been removed.

Figure 2:
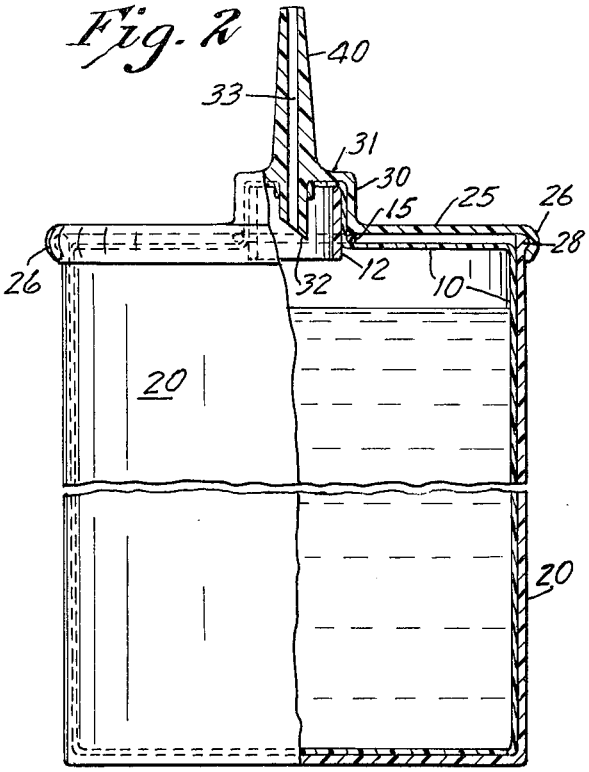
FIG. 2 is a side elevation view of the alternate embodiment of the structure shown in FIG. 1.

In FIG. 2, a similar container structure is shown in a squeeze bottle appliction for liquids or fluids of a more viscous material. The container 20 is formed of a relatively rigid material compared with the flexible walls of the pouch 10 which again includes the tubular element 12 in the upper wall portion of the same. The container walls are deformable for the purpose of forcing fluid within the pouch out of the same in a conventional squeeze bottle application of dispensing. The top wall portion or cover 25 of the container or enclosure is identical with that of the embodiment of FIG. 1 having the downwardly curved edge 26 which fits over the lip 28 and the upper edge of the walls of the container. The dispensing spout structure incorporates the cylindrical hub configuration 30 having the top surface 31 thereon and inwardly positioned piercing element 32 with the passage 33 therein to define the tubular member receiving and piercing means. In this configuration the spout 40 is formed integral with the top surface 31 and has a continuation of the passage 33 therethrough for the purpose of directing the fluid from within the pouch out through the spout. The tubular member 12 with the ridge 36 omitted has the ring 15 positioned around the same to secure the upper wall of the pouch across the end of the tubular member 12 and the piercing element 32 projects through the same as the pouch is installed in the dispensing structure or pouring spout. A frictional fit between the recess in the cylindrical hub or portion 30 and the tubular member 12 with the upper wall portion of the pouch surrounding the same insures a positive grip of the spout on the tubular member 12. The top wall or removable cover 25 is secured to the upper edge of the side walls of the container 10 through the frictional gripping surface of the turned over portion 26 on the ridge 28. The walls of the container 20 are in this embodiment relatively rigid with respect to the flexile pouch material but deformable so that fluid within the pouch 10 may be forced through the passage 33 of the spout and the piercing element.

Figure 3:
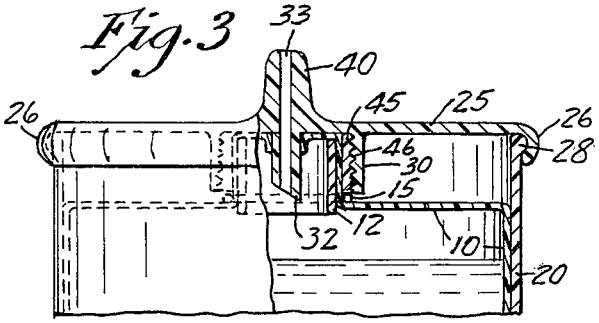
FIG. 3 is a side elevation view of another embodiment of the structure with parts broken away.
Figure 4:
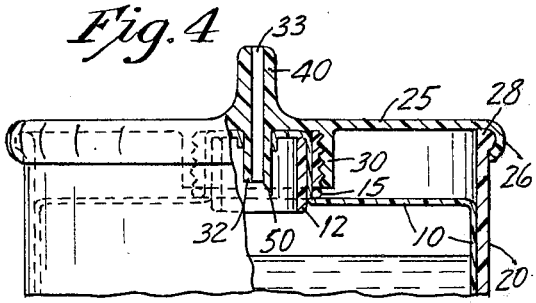
FIG. 4 is a side elevation view of the embodiment shown in FIG. 3 with a modification in the pouring structure.

The embodiment shown in FIGS. 3 and 4 incorporates generally the same type of container 20 with the top closure or wall portion 25 associated therewith. The pouch 10 again is positioned within the enclosure which has the internal configuration to accommodate the pouch in a filled condition. In this embodiment, the pouring spout structure or hub is cylindrical in form and downwardly depending from the top wall structure 25 while formed integral therewith and a suitable pouring spout 40 extends from the upper surface thereof. The piercing element 32 extends into the tubular receiving recess which in this embodiment has a sleeve member 45 press fitted over the tubular element 12 and the upper wall portion of the pouch surrounding the same. The outer peripheral surface of the sleeve member 45 is threaded as to 46 and the inner surface of the downwardly extending spout structure 30 has a similar thread to mate or cooperate with the threaded surface 46 of the sleeve member 45 to positively retain the tubular member 12 within the spout structure. The top wall structure 25 or cover of the container has its peripheral edge curved as at 26 to fit over a flanged or ribbed surface 28 on the upper edge of the walls of the container. Thus, in addition to the retaining ring 15 the upper wall and tubular member, the pouch is frictionally held by means of the sleeve member 45 into which the tubular element extends. In the installation of the pouch, on the pouring structure, the top wall structure and spout portion 30 formed integral therewith is threaded on the threaded surfaced of the sleeve member advancing the piercing element 32 through the upper wall of the pouch extending across the open end of the tubular element. The threaded coupling between the tubular element 12 or its mounting sleeve 45 and the spout portion insures a positive locking arrangement between the tubular element 12 and the cover 25 which is then installed on the upper edge of the container 20 in a clamped configuration. In the embodiment of FIG. 4, the same structural elements are found with the piercing element having a cutting surface 50 positioned on the lower edge of the same to facilitate ease in puncturing or piercing the top wall portion of the pouch 10 as the top wall structure 25 or spout 30 are threaded onto the tubular element 12.

Figure 5:
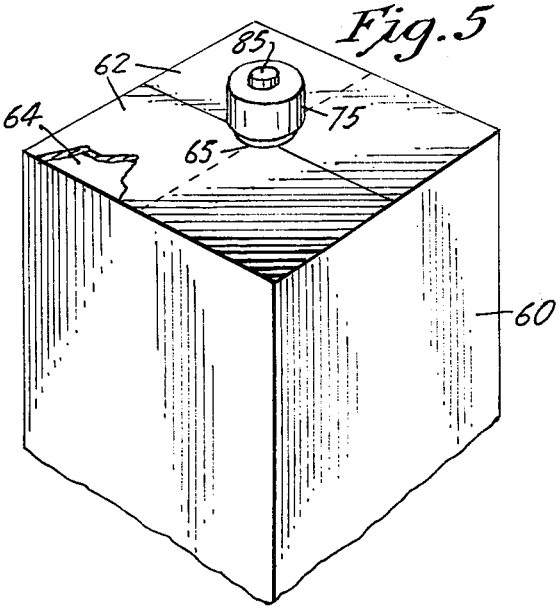
FIG. 5 is a perspective view of another embodiment of the invention with parts broken away.
Figure 6:
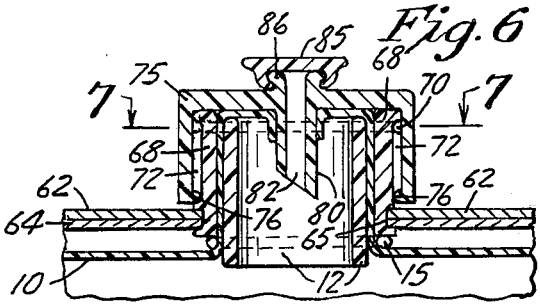
FIG. 6 is a vertical sectional view of the pouring spout of the structure of FIG. 5.
Figure 7:
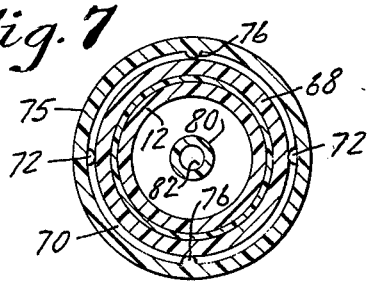
FIG. 7 is a sectional view of the pouring spout structure of FIG. 6 taken along the lines of 7—7 therein.

The embodiment shown in FIGS. 5, 6, and 7 relate to a container which packages the pouch 10 with the tubular element 12 in the upper wall surface of the same. The container or enclosure is a box-like structure 60 which is made of a relatively rigid material compared with the flexible material pouch for the purpose of supporting and enclosing the same. The top wall structure of the box-like enclosure is formed of flap portions 62 and 64 which close on one another in a conventional manner and would normally be sealed through suitable means enclosing the pouch within the same. A recessed groove in the respective flaps define the central passage 65 through the top cover through which the tubular member 12 of the pouch extends. The tubular element 12 is again held in position in the upper wall of the pouch through the retaining ring 15, if desired, with a sleeve member 68 positioned over the tubular element 12 and the upper wall portion as it extends around the extremity of the tubular element. The latter is press fitted onto the tubular element 12 in a friction type fit. As will be seen in FIGS. 6 and 7, the sleeve member 68 has a top circumferental groove 70 positioned on the upper surface of the same and two downwardly extending vertical grooves 72 positioned along the side of the same. The spout structure is a cup shaped member 75 which is positioned over the sleeve member 68 and has inwardly projecting tabs 76 therein which normally ride in the upper circumferential grooves 70. When the tabs are aligned with the vertical grooves 72, the cup shaped spout member 75 may be moved vertically downward with respect to the tubular element 12 and sleeve member 18 around the same to a lowered position as indicated in FIG. 6. The cup shaped spout member 75 has an inwardly directing piercing element 80 with the passage 82 therethrough which is formed integral with the cup shaped spout member 75. As the spout member is moved downwardly, the cylindrical piercing element 80 will pierce the flexible upper wall of the pouch positioned over the end of the tubular element 12 to provide for fluid communications of the passage 82 therethrough to the interior of the pouch. A detachable cover 85 is positioned over the end of the piercing element as it projects in a lipped rigged surface 86 to the opposite side of the spout structure defining a limited spout portion for the purpose of selectively opening or closing the passage. In this embodiment, the supporting container 20 or package will enclose the pouch and the spout structure 75 in the raised position will exposed on the top wall surface of the container 60 defined by the folded flaps integral with the sides of the container. When ever it is desired to open the pouch, the spout member 75 will be rotated so that the tabs 76 will align with the vertical grooves 72 permitting relative movement or downward movement of the spout member 75 relative to the sleeve member 68 and the tubular element 12 causing the piercing element 80 to pierce the upper wall of the pouch at the tubular element 12 and provide for fluid communication of liquid or fluid within the pouch through the spout member. The removable top cap or closure member 85 may be readily removed for pouring or dispensing of the liquid within the pouch and the container 60 will serve as a means for handling or holding the same.

In my improved invention, I have provided several packaging configurations for liquid dispensing pouch shown in my co-pending application Ser. No. 352,581. The packaging or containing structure may take varying forms to provide for different applications such as baby bottles, squeeze bottles or dispensing boxes with the liquid container or fluid-containing flexible pouch positioned therein. The various embodiments of the invention show alternate means of securing the top wall structure and the tubular element of the pouch to the container proper for dispensing purposes. Therefore, in considering this invention, it should be remembered that the present disclosure is illustrative only, and the scope of the invention should be determined by the dependent claims.

What I claim is:

1. In a liquid containing and dispensing device:

a. a sealed liquid-containing pouch having at least one flexible upper wall portion;

b. relatively rigid tubular member positioned within the pouch and its flexible upper wall portion and being secured to said wall portion with the latter extending across one end of the tubular member in sealing relation;

c. means positioned around the rigid tubular member with the flexible upper wall portion of the liquid-containing pouch thereon and securing the tubular member in the upper wall portion of the liquid-containing pouch;

d. a container having relatively rigid side walls surrounding said pouch in supporting relation and having an interior with configurations and dimensions generally complementary to the exterior of said pouch;

e. a top wall structure for the container constructed and arranged to be removably connected to the side wall structure, and, f. a pouring structure integral with the top wall structure and removably connectable to the pouch at the rigid tubular member and including a tubular member receiving and piercing means which receives and positively engages said tubular member in interengaging and telescoping relation, said piercing means piercing said flexible wall portion of said pouch when the latter is so received into the rigid tubular member thereby bringing the same into fluid communication with the interior of said pouch to facilitate pouring of the liquid from said pouch outwardly through said pouring structure.

2. The structure of claim 1 in which the means positioned over the rigid tubular member and the flexible upper wall portion includes a member having a threaded outer surface and the tubular member receiving and piercing means includes an inner threaded surface cooperating with the threaded surface on the member to secure the top wall structure and the spout structure to the rigid side walls of the container and the pouch.

3. The structure of claim 2 and including a cutting surface positioned on the piercing means of the pouring structure and adapted to pierce the flexible upper wall portion of the sealed liquid-containing pouch on the tubular member as the spout structure is threaded onto the member positioned over the tubular rigid member.

4. The structure of claim 1 in which the sealed liquid-containing pouch has flexible bottom, top and side walls.

5. The structure of claim 1 in which the rigid side walls have a flanged upper surface to removably connect the top wall structure thereon.

6. The structure of claim 1 in which the container is formed of a relatively rigid material with respect to the sealed liquid-containing pouch therein and in which the walls of the container are deformable to force liquid from within the pouch through the pouring structure upon deformation.

* * * * *